US010864645B2

(12) United States Patent
Magrone

(10) Patent No.: US 10,864,645 B2
(45) Date of Patent: Dec. 15, 2020

(54) HAIR CUTTING DEVICE

(71) Applicant: KONINKLIJKE PHILIPS N.V., Eindhoven (NL)

(72) Inventor: Gaetano Fabio Magrone, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 15/542,760

(22) PCT Filed: Dec. 31, 2015

(86) PCT No.: PCT/EP2015/081464
§ 371 (c)(1),
(2) Date: Jul. 11, 2017

(87) PCT Pub. No.: WO2016/113119
PCT Pub. Date: Jul. 21, 2016

(65) Prior Publication Data

US 2017/0361479 A1 Dec. 21, 2017

(30) Foreign Application Priority Data

Jan. 15, 2015 (EP) ..... 15151318

(51) Int. Cl.
*B26B 19/44* (2006.01)
*B26B 19/06* (2006.01)
*B26B 19/38* (2006.01)

(52) U.S. Cl.
CPC ..... *B26B 19/44* (2013.01); *B26B 19/06* (2013.01); *B26B 19/388* (2013.01); *B26B 19/3886* (2013.01)

(58) Field of Classification Search
CPC ... B26B 19/06; B26B 19/388; B26B 19/3886; B26B 19/44
USPC ..... 30/34.2, 41–41.6, 43–46, 42, 526–541, 30/194–270
See application file for complete search history.

(56) References Cited

U.S. PATENT DOCUMENTS 2,977,677 A 4/1961 Tice
3,421,216 A 1/1969 Otto
3,464,110 A * 9/1969 Otto ..... B26B 19/38 30/41
3,760,497 A 9/1973 Kuhl et al.
(Continued)

FOREIGN PATENT DOCUMENTS

DE 3804057 A1 8/1989
DE 4326552 A1 2/1995
(Continued)

*Primary Examiner* — Evan H MacFarlane

(57) ABSTRACT

A device for cutting hair includes a housing, a cutting unit arranged at one end of said housing and having a cutting element. The device includes an electrode, and a voltage source connected to the electrode. The voltage source is configured to provide the electrode with an electrostatic charge so that the electrode is configured to attract charges naturally present in hair cut by the cutting unit without actively charging the cut hair and to consequently draw and/or hold the cut hair away from the cutting element. The hair cutting device also has a sensor, which is arranged to detect a condition relating to the use of the device. The voltage source is activated or deactivated depending on said detected condition.

15 Claims, 3 Drawing Sheets

(56) References Cited

U.S. PATENT DOCUMENTS

| | | | | |
|---|---|---|---|---|
| 3,797,206 | A | 3/1974 | Anna | |
| 4,380,121 | A * | 4/1983 | Naimer | B26B 19/38<br>200/61.58 R |
| 6,948,248 | B2 | 9/2005 | Andis et al. | |
| 8,389,906 | B2 | 3/2013 | Azar | |
| 2006/0037197 | A1* | 2/2006 | Hawes | B26B 19/3806<br>30/45 |
| 2006/0174487 | A1* | 8/2006 | Andis | B26B 19/06<br>30/34.05 |
| 2007/0044315 | A1 | 3/2007 | Rozenkranc | |
| 2013/0199348 | A1* | 8/2013 | Aberizk | B26B 19/42<br>83/14 |

FOREIGN PATENT DOCUMENTS

| | | | |
|---|---|---|---|
| DE | 20206181 | U1 | 8/2002 |
| DE | 102010023681 | | 12/2011 |
| GB | 1292351 | A | 10/1972 |
| WO | 9533600 | A1 | 12/1995 |
| WO | 01/54869 | | 8/2001 |
| WO | WO 2013140309 | A1 * | 9/2013 |

* cited by examiner

HAIR CUTTING DEVICE

This application is the U.S. National Phase application under 35 U.S.C. § 371 of International Application No. PCT/EP2015/081464, filed on Dec. 31, 2015, which claims the benefit of International Application No. 15151318.1 filed on Jan. 15, 2015. These applications are hereby incorporated by reference herein.

FIELD OF THE INVENTION

The present invention relates to the field of hair cutting devices.

BACKGROUND OF THE INVENTION

Grooming devices exist for cutting and trimming bodily and facial hair. A known problem with such devices is that cut hair often scatters outside the device, for example because of the kinetic force acquired by the cut hair during cutting, the gravity and/or the elastic properties of hair.

Some hair cutting devices can comprise means for retaining cut-off particles of hair. Such a device is disclosed in GB 1 292 351. GB 1 292 351 discloses a shaver having a cutting head, the cutting head comprising a cutter, a cutting foil and a collecting electrode. The cutting foil and the collecting electrode are connected to a power source so that an electric field is formed between the cutting foil and the collecting electrode. In use, the hair to be cut is introduced into the cutting head through a hole in the cutting foil and gets cut off by the cutter. Before the hair is cut, the hair gets polarised so that once cut by the cutter, the cut hair is attracted onto the collecting electrode.

It is further to be noted that German Offenlegungsschrift DE 43 26 552 A1 discloses a shaving device having a space for retaining debris from the shaving process wherein electrostatic force is used to maintain the debris in this space.

SUMMARY OF THE INVENTION

It is an object of the invention to provide a hair cutting device which substantially alleviates or overcomes the problems mentioned above. In particular, at least in certain embodiments, the present invention sets out to provide a hair cutting device in which scattering of cut hair outside the hair cutting device is avoided.

According to the present invention, there is provided a device for cutting hair comprising:

a housing, a cutting unit arranged at one end of said housing and comprising a cutting element, an electrode, and a voltage source connected to the electrode, wherein the voltage source is configured to provide the electrode with an electrostatic charge so that the electrode is configured to attract charges naturally present in hair cut by the cutting unit without actively charging the cut hair and to consequently draw and/or hold the cut hair away from the cutting element. The cut hair is attracted by the electrode into the hair cutting device and is thereby prevented from scattering outside the hair cutting device, wherein the device comprises a sensor to detect a condition relating to the use of the device, and wherein the voltage source is configured to be activated or deactivated depending on said detected condition.

The device may comprise a proximity sensor configured to detect the position of the hair cutting device relative to the skin of a user. The voltage source may be configured to be activated or deactivated depending on said detected position. The voltage source may be activated if the proximity sensor detects that the hair cutting device is not in the vicinity of the skin of the user. This provides the advantage that the cut hair is retained in the hair cutting device and does not fall out of the hair cutting device, for example when the hair cutting device is not in use.

The device may comprise a motion sensor configured to detect whether the hair cutting device is in motion. The voltage source may be activated if the motion sensor detects that the hair cutting device is in motion. This provides the advantage that the cut hair is retained in the hair cutting device and does not fall out of the hair cutting device when the hair cutting device is in motion.

The voltage source may be configured to provide the electrode with a negative electrostatic charge so that the electrode is configured to attract positive charges naturally present in hair cut by the cutting unit. This provide the advantage that the cut hair is attracted by the electrode without having to be actively charged.

The device may comprise a receptacle for collecting cut hair.

The device may comprise a cutting head and the electrode may be located in the cutting head, proximate to the cutting unit. This allows the hair cutting device to simultaneously cut hair and draw the cut hair away from the cutting unit, thereby preventing cut hair from scattering outside the hair cutting device.

The voltage source may be configured to provide the electrode with an electrostatic charge so that the electrode is configured to hold the cut hair in the receptacle. The electrode may be located in the receptacle. This ensures that the cut hair is retained in the hair cutting device and does not fall out of the hair cutting device.

The electrode may have a generally rounded shape. A generally rounded shaped electrode has the advantage of minimizing edge effects.

The device may comprise two or more electrodes configured to attract charges naturally present in hair cut by the cutting unit.

The device may comprise a suction unit arranged within the housing. The suction unit may be suitable for drawing cut hair into the receptacle.

The voltage source may be configured to provide the electrode with a voltage ranging between −6 kV and −2.5 kV. Such a range of voltage enables the cut hair to be efficiently drawn away from the cutting unit.

The voltage source may comprise an ionizer. An ionizer has the advantage of being an economical, easily retrievable and relatively compact component. Alternatively, the voltage source may comprise a network of diodes and capacitors.

These and other aspects of the invention will be apparent from and elucidated with reference to the embodiments described hereinafter.

BRIEF DESCRIPTION OF THE DRAWINGS

Embodiments of the invention will now be described, by way of example only, with reference to the accompanying drawings, in which.

DETAILED DESCRIPTION OF THE EMBODIMENTS

Figure 1:
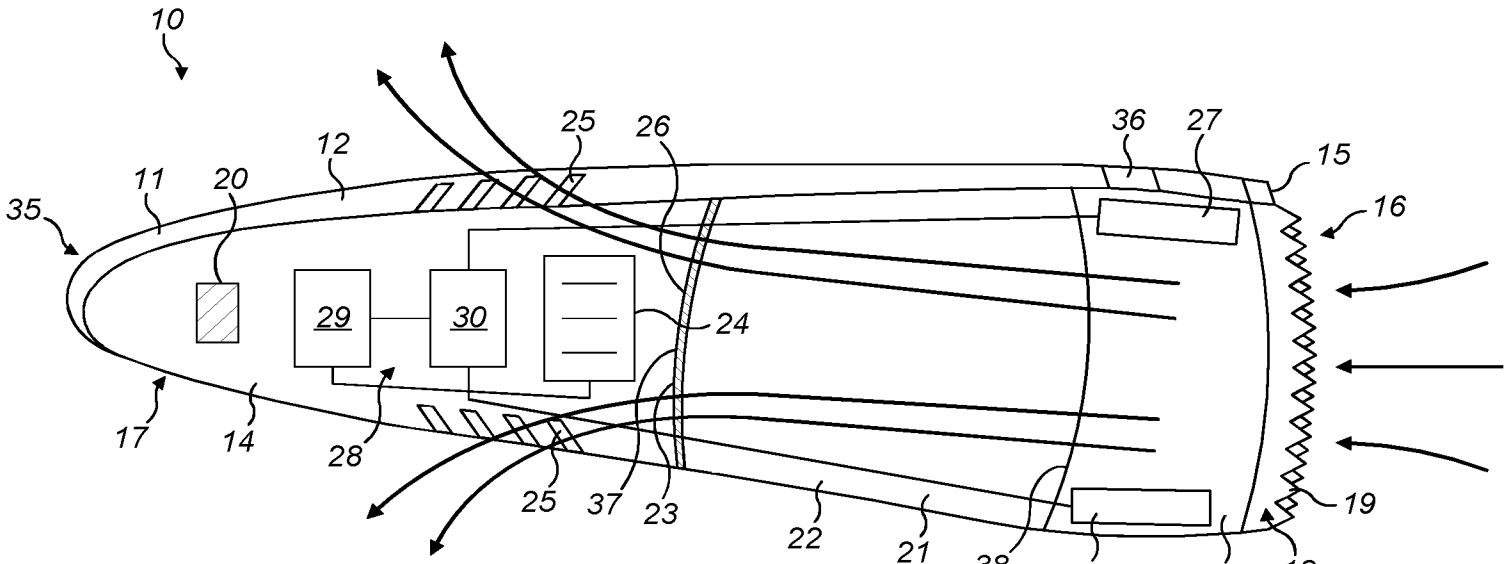
FIG. 1 shows a diagrammatic cross-sectional view of a hair cutting device.

Referring to FIG. 1, a hair cutting device 10 is shown. In the present arrangement, the hair cutting device 10 is a hair clipper. In a variant, the hair cutting device is a beard trimmer.

The hair clipper 10 comprises a housing 11 having a sidewall 12, a cutting head 13 and a handle portion 14. The cutting head 13 has a cutting face 15 located at a distal end 16 of the housing 11. The handle portion 14 is located in a proximal region 17 of the housing 11 opposed to the distal end 16.

The hair clipper 10 comprises a cutting unit 18 for cutting hair. The cutting unit 18 is located at the distal end 16 of the housing 11. The cutting unit 18 comprises two cutting blades 19. As it is well known by the person skilled in the art, one of the cutting blades 19 is stationary and the other of the blades 19 is moving in a reciprocating manner with respect to the stationary blade. The reciprocating cutting blade is driven in well-known fashion by a first electric motor (not shown). Both cutting blades 19 are toothed, such that the hair to be clipped is caught by the stationary blade like a comb and then severed by the moving teeth of the reciprocating blade. A power supply 29 such as a battery is provided in the housing 11 and supplies electric power to the first electric motor. A switch 20 is provided on the sidewall 12 of the housing 11 to switch on or switch off the first electric motor.

The hair clipper 10 comprises a receptacle 21 for collecting the hair cut by the cutting unit 18. The receptacle 21 is located in the handle portion 14. The receptacle 21 is in the form of a hollow chamber 22 delimited by a wall 23. The receptacle 21 is suitable for receiving and storing hair cut by the cutting unit 18. The receptacle 21 may be removable from the housing 11 to be emptied.

The hair clipper 10 comprises a suction unit 24. The suction unit 24 is arranged within the housing 11. The suction unit 24 is suitable for drawing cut hair away from the cutting unit 18. In particular, the suction unit 24 is suitable for drawing cut hair into the receptacle 21. The suction unit 24 is located in the handle portion 14. The suction unit 24 is located between the receptacle 21 and a proximal end 35 of the housing 11. The suction unit 24 comprises a fan (not shown). The fan is driven by a second motor (not shown) powered by the battery 29. The fan is configured to rotate and therefore transport air, thereby generating a vacuum to suck the clipped hair together with the air taken in by the fan. Air exhausts 25 are provided in the sidewall 12 of the housing 11 to allow for air sucked by the suction unit 24 to exit the hair clipper 10. The second motor is configured to be switched on or off by the switch 20.

A filter 26 is provided in the housing 11. The filter 26 is disposed along a proximal portion 37 of the wall 23 of the receptacle 21. The filter 26 ensures that the air sucked by the suction unit 24 can pass through the receptacle 21 whilst the cut hair is retained inside the receptacle 21.

As shown in FIG. 1, the hair clipper 10 comprises first and second electrodes 27 and a voltage source 28 electrically connected to the first and second electrodes 27.

Each electrode 27 is made with a conductive material, such as nickel-plated brass. Each electrode 27 has a cylindrical shape. More generally, the electrodes 27 have a generally rounded shape. A generally rounded shaped electrode is free from sharp edges and has therefore the advantage of minimizing edge effects.

Figure 2A:
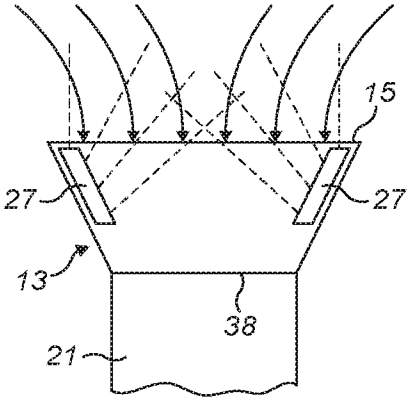
FIGS. 2A to 2D show different configurations for the electrode(s) of the hair cutting device according to FIG. 1.

As shown in FIG. 2A, the electrodes 27 are located in the cutting head 13. The electrodes 27 are located proximate to the cutting unit 18. In particular, the electrodes 27 are located proximate to the cutting blades 19. Each electrode 27 is positioned along the sidewall 12 of the housing 11 so that the first and second electrodes 27 face each other in the cutting head 13.

Figure 2B:
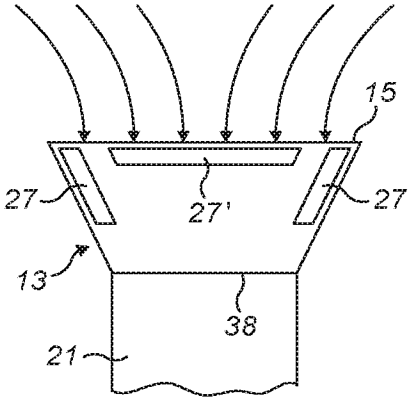
Figure 2C:
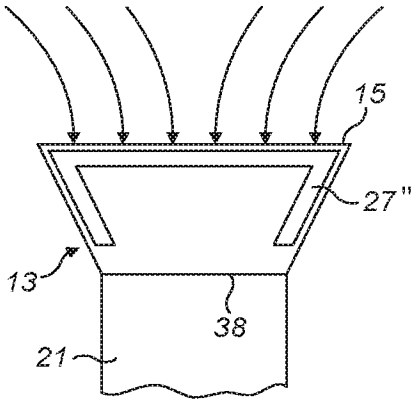
Figure 2D:
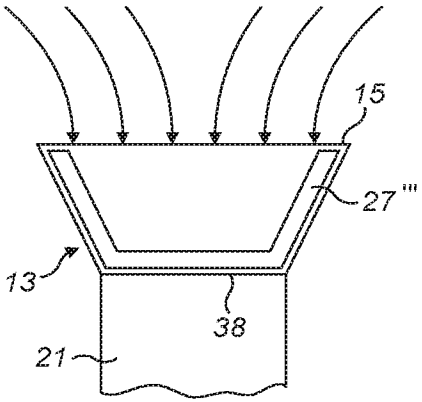

In a variant, represented in FIG. 2B, the hair clipper 10 comprises a third electrode 27' in addition to the first and second electrodes 27. The third electrode 27' extends along the cutting face 15. The third electrode 27 extends substantially parallel to the cutting face 15. The third electrode 27' extends transversally to the first and second electrodes 27. In a further variant, shown in FIG. 2C, the first, second and third electrodes 27" may be joined together to form a single electrode 27. In a still further variant, shown in FIG. 2D, the third electrode 27' may be positioned opposed to the cutting face 15 in the cutting head 13, for example along a distal portion 38 of the wall 23 of the receptacle 21.

As visible in FIG. 1, the voltage source 28 is located in the handle portion 14. The voltage source 28 is configured to provide the electrodes 27 with an electrostatic charge so that the electrodes 27 are configured to attract charges naturally present in hair cut by the cutting unit 18 without actively charging the cut hair and to consequently draw the cut hair away from the cutting blades 19. In particular, the voltage source 28 is configured to provide the electrodes 27 with negative charges so that the electrodes 27 are configured to attract positive charges naturally present in hair cut by the cutting blades 19. In the present arrangement, the voltage source 28 comprises the battery 29, coupled to an ionizer 30. An ionizer has the advantage of being an economical, easily retrievable and relatively compact component. In the present arrangement, the size of the ionizer 30 is approximately 1 cm by 1 cm by 2 cm. The voltage source 28 is configured to output a negative voltage in the kilovolt range, for example ranging between −6 kV and −2.5 kV, and in particular approximately equal to −4.5 kV. A voltage multiplier (not shown) may be provided between the battery 29 and the ionizer 30 to multiply the battery voltage and provide an input voltage to the ionizer 30 ranging, for example, between 100V and 250V. It will be noted that any other kind of voltage source 28 suitable for outputting a negative voltage in the kilovolt range can be used. In particular, any other kind of voltage source 28 suitable for outputting a negative voltage ranging between −6 kV and −2.5 kV can be used. For example, a battery coupled to a transformer, or a battery coupled to a voltage multiplier, such as network of diodes and capacitors, could be used as the voltage source 28. Alternatively, the voltage source 28 could comprise a network of high voltage capacitors connected in parallel, the high voltage capacitors being configured to simultaneously move to a configuration in series to create an electric arc.

The voltage source 28 is configured to be switched on or off by the switch 20. Alternatively, an additional switch 36 may be provided on the sidewall 12 of the housing 11 to switch on or switch off the voltage source 28 independently of the cutting unit 18 and the suction unit 24.

The cutting head 13 may be made of a transparent material so that the electrode 27 may be visible from outside the hair clipper 10. As shown in FIGS. 2A to 2D, the cutting head 13 may have a trapezoidal shape in order to optimize the orientation of the electrodes 27 and thus the orientation of the electric field generated by the electrodes 27 (as illustrated by the dashed lines in FIG. 2A).

In use, the hair clipper 10 is switched on by a user by means of the switch 20, and positioned against the skin of the user comprising hair to be clipped. Once the hair clipper 10 is switched on and positioned against the hair, the cutting unit 18 operates to cut hair. The hair gets caught by the stationary blade and is then cut by the moving teeth of the reciprocating blade of the cutting unit 18.

Once the switch 20 is activated, the suction unit 24 is activated. While rotating, the fan transports air and creates a vacuum which sucks the cut hair together with the air taken in by the fan, away from the cutting unit 18, as shown by the arrows in FIG. 1. The cut hair is drawn away from the cutting unit 18 and received in the receptacle 21. The cut hair is kept within the receptacle 21 by means of the filter 26. The air sucked by the suction unit 24 exits the hair clipper 10 through the air exhausts 25.

Once the switch 20 is activated, the voltage source 28 is also activated. The ionizer 30 provides the electrodes 27 with negative electric charges, thereby creating a negative electrostatic charge at the electrodes 27. The electrodes 27 are therefore negatively charged while the hair is being cut by the cutting unit 18. As the cut hair is naturally positively charged, i.e. naturally comprises positive electric charges, the cut hair is attracted by the negative electrostatic charge of the electrode 27 into the cutting head 13 and away from the cutting blades 19. In particular, the positive charges of the hair are attracted by the negative charges located at the electrodes 27, so that the cut hair is attracted into the cutting head 13 towards the electrode 27. The negatively charged electrode 27 helps to attract the cut hair into the hair clipper 10, thereby preventing cut hair from falling around the hair clipper 10.

The combined action of the negatively charged electrode 27 and the suction unit 24 helps to attract the cut hair into the hair clipper 10 in an efficient way and helps to prevent cut hair from scattering outside the hair clipper 10.

Figure 3:
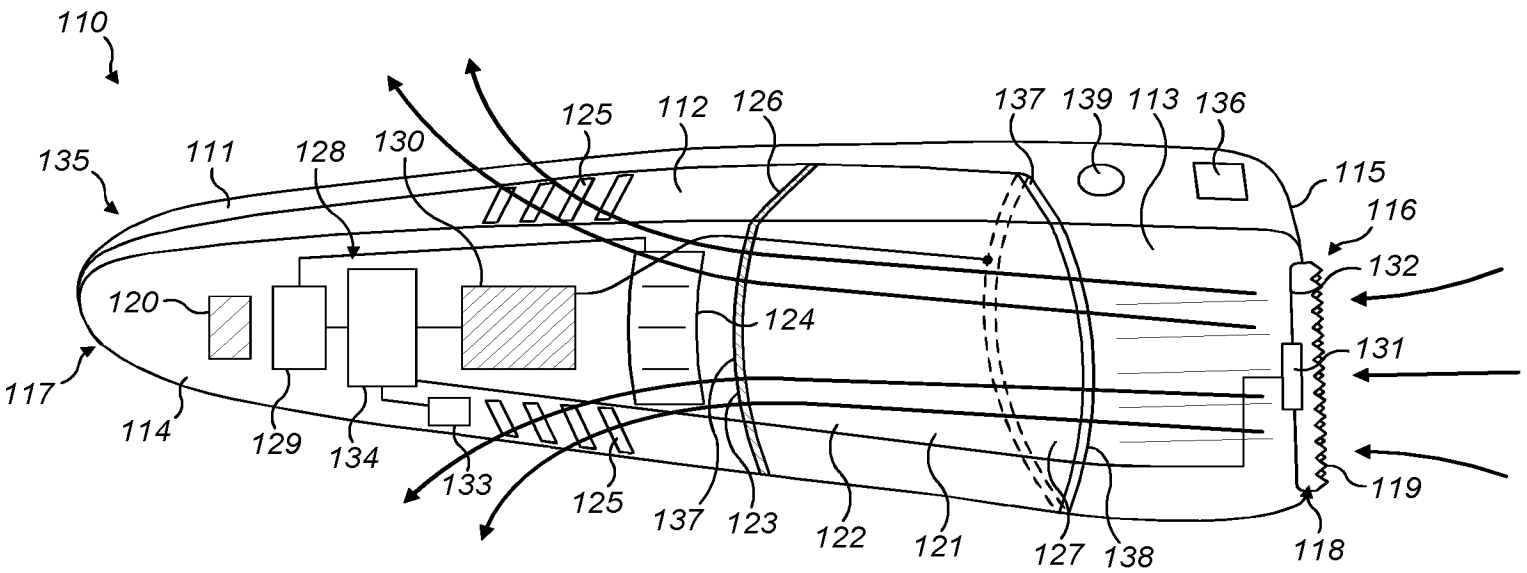
FIG. 3 shows a diagrammatic cross-sectional view of a hair cutting device according to an embodiment of the present invention.

A hair cutting device 110 according to an embodiment of the present invention is shown in FIG. 3. This embodiment corresponds closely to the device shown in FIG. 1 and like reference numerals have been used for like components, albeit incremented by 100 for clarity. Only the differences in relation to the first embodiment are described below.

In the embodiment of FIG. 3, the hair clipper 110 comprises a single electrode 127 located in the receptacle 121 of the hair clipper 110. In particular, the electrode 127 is disposed along the distal portion 138 of the wall 123 of the receptacle 121.

In the embodiment of FIG. 3, the voltage source 128 is configured to provide the electrode 127 with an electrostatic charge so that the electrode 127 is configured to attract charges naturally present in hair cut by the cutting unit 118 without actively charging the cut hair and to consequently hold the cut hair away from the cutting blades 119. In particular, the electrode 127 is configured to hold the cut hair in the receptacle 121.

As shown in FIG. 3, the electrode 127 is generally ring-shaped. In a variant, the hair clipper 110 comprises two or more electrodes 127 located in the receptacle 121 and configured to hold the cut hair in the receptacle 121. For example, the hair clipper 110 comprises two generally semi-circular electrodes 127 arranged relative to each other to form a generally ring-shaped electrode assembly. The two electrodes 127 are located along the distal portion 138 of the wall 123 of the receptacle 121.

The hair clipper 110 according to the embodiment of FIG. 3 comprises a proximity sensor 131 for detecting the position of the hair clipper 110 relative to the skin of the user. The proximity sensor 131 is located on the cutting face 115. In particular, the proximity sensor 131 is located on an external surface 132 of the cutting face 115.

The hair clipper 110 comprises a motion sensor 133 for detecting whether the hair clipper 110 is in motion.

The proximity sensor 131 and the motion sensor 133 are connected to a controller 134. The controller 134 is located in the handle portion 114. The controller 134 is connected to the voltage source 128. The controller 134 is powered by the battery 129.

The controller 134 is configured to receive information from the proximity sensor 131 and to control the voltage source 128 depending on said received information. In particular, the controller 134 is configured to activate or deactivate the voltage source 128 depending on the position of the hair clipper 110 relative to the skin of the user detected by the proximity sensor 131. The controller 134 is configured to activate the voltage source 128 if the proximity sensor 131 detects that the hair clipper 110 is not in the vicinity of the skin of the user. For example, the voltage source 128 is activated if the hair clipper 110 is at least 4 mm away from the skin of the user. Alternatively, the voltage source 128 may be activated if the hair clipper 110 is in the vicinity of the skin of the user, for example if the cutting unit 118 is located less than 4 mm from the skin of the user or is in contact with the skin of the user.

Likewise, the controller 134 is configured to receive information from the motion sensor 133 and to control the voltage source 128 depending on said received information. In particular, the controller 134 is configured to activate the voltage source 128 if the motion sensor 133 detects that the hair clipper 110 is in motion.

The voltage source 128 may be activated if the proximity sensor 131 detects that the hair clipper 110 is not in the vicinity of the skin of the user and if the motion sensor 133 detects that the hair clipper 110 is in motion.

The voltage source 128 may remain activated for a limited period of time once the hair clipper 110 is switched off. For example, the voltage source 128 may remain activated during approximately one minute after the hair clipper is switched off. Thus, the electrode 127 remains charged and keeps holding the cut hair in the receptacle 121 even after the hair clipper 110 is switched off.

An indicator such as a light-emitting diode 139 may be provided on the sidewall 112 of the housing 111 to indicate whether the voltage source 128 is activated.

It will be appreciated that operation of the hair cutting device according to the embodiment of FIG. 3 is unchanged from that of FIG. 1. However, in the embodiment of FIG. 3, when the voltage source 128 is activated, the electrode 127 holds the cut hair in the receptacle 121. When the electrode 127 is charged, the electrode 127 acts as a "lock" and prevents cut hair from escaping the receptacle 121. Moreover, the voltage source 128 is activated only if the proximity sensor 131 detects that the hair clipper 110 is not in the vicinity of the skin of the user.

The controller 134 may use the proximity sensor 131 in combination with the motion sensor 133 to activate or deactivate the voltage source 128. For example, the electrode 127 in the receptacle 121 may be provided with negative charges only when the hair clipper 110 is in motion and when the hair clipper 110 is not in the vicinity of the skin of the user.

While embodiments of the invention have been illustrated and described in detail in the drawings and foregoing description, such illustration and description are to be considered illustrative or exemplary and not restrictive, and the invention not limited to these embodiments.

It will be appreciated that the term "comprising" does not exclude other elements or steps and that the indefinite article "a" or "an" does not exclude a plurality. A single processor may fulfil the functions of several items recited in the claims. The mere fact that certain measures are recited in mutually different dependent claims does not indicate that a combination of these measures cannot be used to an advantage. Any reference signs in the claims should not be construed as limiting the scope of the claims.

Although claims have been formulated in this application to particular combinations of features, it should be understood that the scope of the disclosure of the present invention also includes any novel features or any novel combinations of features disclosed herein either explicitly or implicitly or any generalisation thereof, whether or not it relates to the same invention as presently claimed in any claim and whether or not it mitigates any or all of the same technical problems as does the parent invention. The applicants hereby give notice that new claims may be formulated to such features and/or combinations of features during the prosecution of the present application or of any further application derived therefrom.

The invention claimed is:

1. A device for cutting hair comprising:

a housing;

a cutting unit arranged at a distal end of the housing and comprising a cutting element;

a cutting head comprising a cutting face disposed at the distal end of the housing, the cutting head having a first side extending from the cutting face, and the cutting head having a second side extending from the cutting face, the first and second sides being spaced apart and facing each other;

a first electrode disposed on the first side, and a second electrode disposed on the second side;

a voltage source connected to the first and second electrodes;

a controller, wherein the voltage source is configured to provide the first and second electrodes with an electrostatic charge so that the first and second electrodes are configured to attract charges naturally present in hair cut by the cutting unit without actively charging the hair cut by the cutting unit, and to consequently draw and/or hold the hair cut by the cutting unit away from the cutting element; and a proximity sensor adapted to detect a position of the device relative to skin of a user, wherein the controller is configured, based on an input from the proximity sensor, to activate or deactivate the voltage source when the cutting unit is in a vicinity of the skin of the user.

2. A device according to claim 1, wherein the controller is configured to activate the voltage source when the cutting unit is located less than 4 mm from the skin of the user.

3. A device according to claim 1, wherein the controller is configured to activate the voltage source when the cutting unit is in contact with the skin of the user.

4. A device according to claim 1, comprising a motion sensor configured to detect whether the hair cutting device is in motion.

5. A device according the claim 4, wherein the motion sensor is connected to the controller.

6. A device according the claim 1, comprising a receptacle for collecting the hair cut by the cutting unit.

7. A device according to claim 1, wherein the first and second electrodes are located in the cutting head proximate to the cutting unit.

8. A device according the claim 6, wherein the voltage source is configured to provide the first and second electrodes with the electrostatic charge so that the first and second electrodes are configured to hold the hair cut by the cutting unit in the receptacle.

9. A device according to claim 8, wherein the first and second electrodes are located in the receptacle.

10. A device according to claim 6, comprising a suction unit arranged within the housing, wherein the suction unit is suitable for drawing the hair cut by the cutting unit into the receptacle.

11. A device according to claim 1, wherein the voltage source is configured to provide the first and second electrodes with a voltage ranging between −6 kV and −2.5 kV.

12. A device according to claim 1, wherein the voltage source comprises an ionizer.

13. A device according to claim 1, wherein the voltage source comprises a network of diodes and capacitors.

14. A device according to claim 1, wherein each of the first and second electrodes has parallel sides.

15. A device as claimed in claim 1, further comprising a third electrode disposed along the cutting face.

* * * * *